US005936644A

United States Patent [19]

Ono et al.

[11] Patent Number: 5,936,644

[45] Date of Patent: Aug. 10, 1999

[54] HEAD DRIVING DEVICE OF INK-JET PRINTER

[75] Inventors: Shunichi Ono; Noboru Nitta; Jun Takamura, all of Shizuoka-ken, Japan

[73] Assignee: Kabushiki Kaisha TEC, Shizuoka, Japan

[21] Appl. No.: 08/760,578

[22] Filed: Dec. 4, 1996

[30] Foreign Application Priority Data

Dec. 5, 1995 [JP] Japan ..... 7-316438
Nov. 6, 1996 [JP] Japan ..... 8-293551

[51] Int. Cl.[6] ..... B41J 2/07

[52] U.S. Cl. ..... 347/10; 347/11

[58] Field of Search ..... 347/9, 10, 12, 347/11, 13, 15

[56] References Cited

U.S. PATENT DOCUMENTS

| | | | |
|---|---|---|---|
| 4,409,596 | 10/1983 | Ishii | 346/1.1 |
| 4,673,951 | 6/1987 | Mutoh et al. | 347/15 |
| 4,714,935 | 12/1987 | Yamamoto et al. | 346/140 R |
| 4,887,100 | 12/1989 | Michaelis et al. | 346/140 R |
| 4,908,635 | 3/1990 | Iwasawa et al. | 346/140 R |
| 5,028,812 | 7/1991 | Bartky | 307/246 |
| 5,124,716 | 6/1992 | Roy et al. | 346/1.1 |
| 5,170,177 | 12/1992 | Stanley et al. | 346/1.1 |
| 5,381,170 | 1/1995 | Mutoh | 347/15 |
| 5,604,519 | 2/1997 | Keefe et al. | 347/13 |

FOREIGN PATENT DOCUMENTS

| | | | |
|---|---|---|---|
| 0640480 A2 | 3/1995 | European Pat. Off. | 347/13 |
| 55-113579 | 9/1980 | Japan | 347/12 |
| 62-25058 | 2/1987 | Japan | 347/15 |
| 1-101160 | 4/1989 | Japan | 347/13 |
| 3-108550 | 5/1991 | Japan | 347/13 |
| 6-286136 | 10/1994 | Japan | 347/13 |
| WO 94/26522 | 11/1994 | WIPO | 347/15 |

*Primary Examiner*—John Hilten
*Attorney, Agent, or Firm*—Frishauf, Holtz, Goodman, Langer & Chick, P.C.

[57] ABSTRACT

A head driving device includes an ink-jet head having a large number of ink chambers arranged side by side and separated by piezoelectric elements, FETs for connecting electrodes of the ink chambers to a +Vcc power source line, FETs for connecting the electrodes of the ink chambers to a −Vcc power source line, bi-directional switches for connecting the electrodes of the ink chambers to a ground line, selectors each for selecting one of a plurality of pulse signals in which at least one of the pulse width and pulse interval is different according to gradation data, sequencers for generating sequence signals according to the pulse signals from the selectors, and decoders for decoding the sequence signals into driving signals and supplying them to the FETs and bi-directional switches. Particularly, the head driving device changes the voltage and timing for causing the piezoelectric element to effect the distorting operation according to the selected pulse signal so as to change an amount of ink ejected from the ink chamber and perform the gradation printing for each dot.

14 Claims, 8 Drawing Sheets

HEAD DRIVING DEVICE OF INK-JET PRINTER

BACKGROUND OF THE INVENTION

1. Field of the Invention

This invention relates to a head driving device of an ink-jet printer having an ink-jet head which utilizes electrostrictive elements for causing variations in pressure in ink chambers by the distorting operation thereof.

2. Description of the Related Art

A line thermal printer is known as a line printer having a larger number of recording elements arranged in a line. As shown in FIG. 11, the line thermal printer has a system bus 1 which is connected to a CPU (Central Processing Unit) 2 constructing the main body of a control section, a ROM (Read Only Memory) 3 storing program data and the like, an interface (I/F) 4 for effecting the transmission/reception control with respect to an external host computer (not shown) and receiving a printing command and print data from the host computer, an image RAM (Random Access Memory) 5 for storing image data created by developing received print data into a bit map form, and an ASIC 7 for supplying an energization signal to a driver 6 which controls energization of heating elements of the line thermal head.

The driver 6 is constructed by cascade-connecting a large number of driver ICs 6*a* each including a shift register 8, latch circuit 9, AND gate circuit 10, and switching circuit 11 as shown in FIG. 12. That is, the driver 6 is constructed by connecting a large number of driver ICs 6*s* such that the data output terminal DO of a preceding stage driver IC 6*a* is connected to the data input terminal DI of a next stage driver IC 6*a*.

The thermal line printer transfers image data read out from the image RAM 5 via the ASIC 7 to the data input terminal DI of the driver 6, and stores them in the shift register 8 which sequentially shifts the image data in response to a clock CK. When a series of image data is stored into the shift register 8, the data stored therein are latched by the latch circuit 9 in response to a latch signal LT. Then, outputs of the logical AND of the outputs of the latch circuit 9 and an energization signal FIRE are supplied from the AND circuit 10 to respective switching elements of the switching circuit 11, thereby selectively turning ON the switching elements to supply print outputs. The heat-generating elements perform a printing of dots by selectively generating heat according to the print outputs. That is, as shown in FIG. 13, each of heat-generating elements 12 is connected in series with a switching element 13 such as an FET between +VCC and ground terminals. Energization of the heat-generating element 12 is controlled by setting the switching element 13 in the ON state for a preset period of time by an energization signal F from a corresponding one of the AND gates of the AND circuit 10. FIG. 14 shows the timings of the latch data, energization signal FIRE, and print output used in the above operation. FIG. 15 shows the timings of the image data stored into the shift register 8 via the data input terminal DI, clock CK, latch signal LT, latch data, energization signal FIRE and print output. However, the head driving device of the above line thermal printer simply controls energization or de-energization of the heat-generating elements.

As the head driving device of an ink-jet printer having the ink-jet head using a piezoelectric or electrostrictive elements, a head driving device of a serial ink-jet printer is known. For example, Jpn. Pat. Appln. KOKAI Publication No. 6-286136 discloses an ink-jet head is constituted by a column of ink chambers having electrodes formed therein and separated by partition walls of piezoelectric elements (the number of ink chambers corresponds to a number of vertical dots required for one-line printing). Each electrode of the head is connected to a driving circuit formed of switching elements respectively serving as charging and discharging circuits. Each of the piezoelectric element is sequentially distorted by sequentially changing a voltage applied to a corresponding one of the electrodes of the head to different voltage levels, for example, $+V \rightarrow 0 \rightarrow -V/2$, according to a sequence of ON and OFF states of the switching elements to apply pressure to the ink chamber and eject ink in the ink chamber so as to effect the dot printing operation. When the partition wall of the piezoelectric element is distorted to apply pressure to the ink chamber, the volume of an ink chamber adjacent to the above ink chamber increases to set a negative pressure state so that the control operation for simultaneously applying pressure to both of the adjacent ink chambers cannot be effected in the case of an ink-jet head using the piezoelectric element as the partition wall, and therefore, the dot printing operation for one column is effected by a so-called two-cycle driving method in which the process for operating the alternate ink chambers is effected twice, for example.

When the gradation printing is performed for each printing dot by use of a printer using the ink-jet head for ejecting ink by utilizing the electrostriction of the piezoelectric element, signals for controlling voltages applied to the piezoelectric elements and the application timings thereof, that is, a sequence of the ON and OFF operations of a plurality of switching elements of the driving circuit and the time lengths of the ON and OFF states are issued from control circuits provided for the respective dots and control signals which are different for respective dots and correspond in number to the dots are prepared and used for changing the degrees of electrostriction of the piezoelectric elements and the timings of electrostriction thereof.

However, since the head driving device of the serial ink-jet printer using the piezoelectric elements effects the operation for distorting the piezoelectric elements of the ink-jet head for each column and repeatedly effecting the distorting operations for one line to attain the one-line printing, a relatively long time is required for the printing, and if an attempt is made to attain a certain printing speed, restrictions are imposed on the permissible time for the operation of the piezoelectric elements of one column and the electrostriction degrees of the piezoelectric elements and the electrostriction timings thereof cannot be sufficiently changed, thereby causing a problem that satisfactory gradation printing cannot be attained. On the other hand, if an attempt is made to set the permissible time for the operation of the piezoelectric elements of one column sufficiently long so as to sufficiently change the electrostriction degrees of the piezoelectric elements and the electrostriction timings thereof, there occurs a problem that the printing speed is lowered.

Further, in order to perform the gradation printing for each printing dot, it is necessary to simultaneously prepare voltage levels and timings which are different for respective dots in one column and control them for respective dots of one line while changing them at the column frequency, thus causing a problem that the control operation becomes complicated.

SUMMARY OF THE INVENTION

A first object of this invention is to provide a head driving device of an ink-jet printer capable of performing the gradation printing for respective dots and enhancing the printing speed by use of a relatively simple control operation for using an ink-jet head which has a plurality of ink chambers and electrodes for the respective ink chambers arranged side by side and includes groups of electrostrictive elements for causing variations in pressure in the ink chambers by the distorting operation thereof as a print head and changing the energization sequence for simultaneously distorting the grouped electrostrictive elements of the head.

A second object of this invention is to provide a head driving device of an ink-jet printer capable of correcting a deviation of printing dots between adjacent ink chambers.

A third object of this invention is to provide a head driving device of an ink-jet printer which can derive various driving waveforms from driving waveform information of ink chambers requiring a small number of signal lines by inputting a pulse waveform converted from the driving waveform information to a driving circuit and decoding the driving waveform information in the driving circuit to drive a head and which can effect the precise driving waveform control by use of a small number of signal lines even when it is desired to change the driving waveform from outside the driving circuit.

A fourth object of this invention is to provide a head driving device of an ink-jet printer which independently selects driving waveform information for each ink chamber from different types of driving waveform information commonly supplied to drive ink chambers and effects the driving control so that it is not necessary to provide a control signal generation circuit for each ink chamber and the circuit can be simplified even when it is required to change the gradation for each ink chamber, which can effect the precise driving control since a desired waveform can be freely selected for each ink chamber, and which can adjust the driving waveform from the exterior even if the driving circuit is formed in an IC form to make it impossible to change the circuit construction and can cope with a case wherein it becomes necessary to adjust the driving waveform according to a change in the ink ejection characteristic caused by the change of ink or the like.

According to a first aspect of this invention, there is provided a head driving device of an ink-jet printer comprising an ink-jet head having a plurality of ink chambers and electrodes for the respective ink chambers arranged side by side and including electrostrictive elements for causing variations in pressure in the ink chambers by the distorting operation thereof; a plurality of semiconductor switching elements for connecting the electrodes to power source lines; a shift memory for sequentially fetching multivalue gradation data for representing respective printing dots by gradation for respective dots; pulse signal selecting means for obtaining groups of pulse signals in which at least one of the pulse width, pulse interval and the number of pulses is different and which corresponds in number to the gradations and selecting pulse signal corresponding to respective printing dots based on multivalue gradation data for the respective printing dots from the shift memory; a sequencer for generating sequence signals for determining energization sequences corresponding to the gradations according to the pulse signals from the pulse signal selecting means; and a decoder for respectively supplying the sequence signals from the sequencer to the semiconductor switching elements; wherein the semiconductor switching elements are selectively turned ON and OFF according to the sequence signals to sequentially distort the electrostrictive elements, thereby changing pressure applied to ink in the ink chambers.

According to a second aspect of this invention, there is provided a head driving device of an ink-jet printer comprising an ink-jet head having a plurality of ink chambers and electrodes for the respective ink chambers arranged side by side and including electrostrictive elements for causing variations in pressure in the ink chambers by the distorting operation thereof; a plurality of semiconductor switching elements for connecting the electrodes to power source lines; a shift memory for sequentially fetching multivalue gradation data for representing respective printing dots by gradation for respective dots; pulse signal selecting means for obtaining groups of pulse signals in which at least one of the pulse width, pulse interval and the number of pulses is different and which corresponds in number to the gradations, changing the positions of the pulse signals according to the respective gradations and selecting pulse signals corresponding to respective printing dots based on multivalue gradation data for the respective printing dots from the shift memory; a sequencer for generating sequence signals for determining energization sequences corresponding to the gradations according to the pulse signals from the pulse signal selecting means; and a decoder for respectively supplying the sequence signals from the sequencer to the semiconductor switching elements; wherein the semiconductor switching elements are selectively turned ON and OFF according to the sequence signals to sequentially distort the electrostrictive elements, thereby changing pressure applied to ink in the ink chambers and correcting a deviation of the printing dots between the adjacent chambers by the positional change of the pulse signals.

According to a third aspect of this invention, there is provided a head driving device of an ink-jet printer capable of independently controlling the ink ejection characteristics for respective ink chambers according to driving waveforms applied to drive the chambers of an ink-jet head having electrodes arranged side by side and including electrostrictive elements for causing variations in pressure in the ink chambers by the distorting operation thereof, comprising means for supplying pulse signals each containing driving waveform information encoded into the number of points of change in the pulse waveform and the time length of the change; driving waveform information decoding means for decoding driving waveform information items from the respective pulse signals according to changes of the pulse signals supplied from the supplying means; and electrode driving means for driving the electrostrictive elements of the head of the ink-jet printer according to the driving waveform information items decoded by the decoding means.

According to a fourth aspect of this invention, there is provided a head driving device of an ink-jet printer capable of independently controlling the ink ejection characteristics for respective ink chambers according to driving waveforms applied to electrodes corresponding to the ink chambers of an ink-jet head having a plurality of ink chambers and electrodes for the respective ink chambers arranged side by side and including electrostrictive elements for causing variations in pressure in the ink chambers by the distorting operation thereof, comprising a plurality of driving circuits each including a pulse signal input section for receiving plural types of pulse signals containing coded driving waveform information items which are different from one another, selection means for selecting one pulse signal from the plural types of pulse signals from the pulse signal input section, a switching circuit group including a plurality of semiconductor switching elements for effecting the switching operations to apply driving waveforms to the electrodes of the respective ink chambers, switching control circuits for creating signals for driving the semiconductor switching elements according to the pulse signals selected by the selection means, and output sections for outputting electrode driving waveform signals from the switching circuit group; wherein the pulse signal input sections of the respective driving circuits are commonly supplied with the plural types of pulse signals, the output sections of each of the driving circuits are connected to the electrodes of the respective ink chambers, each of the selection means of the driving circuits independently selects one pulse signal from the input plural types of pulse signals for each of the driving circuits, and the switching control circuits of each of the driving circuits change the ON and OFF states of the plurality of semiconductor switching elements of the switching circuit group with time according to variations with time in the pulse signals selected by the corresponding selection means and independently select and control the driving waveforms applied to the electrodes of the respective ink chambers for the respective ink chambers.

According to a fifth aspect of this invention, there is provided a head driving device of an ink-jet printer which has the construction of the fourth aspect and in which each of the switching control circuits of the plurality of driving circuits includes a sequencer operated according to a pulse signal; and a decoder for logically converting an output of the sequencer into signals for driving the plurality of semiconductor switching elements.

According to a sixth aspect of this invention, there is provided a head driving device of an ink-jet printer which has the construction of the fourth aspect and in which each of the switching control circuits of the plurality of driving circuits includes a sequencer operated according to a pulse signal; a latch circuit for latching an output of the sequencer; a circuit for controlling the latch timing of the latch circuit; and a decoder for logically converting a latch output of the latch circuit into signals for driving the plurality of semiconductor switching elements.

According to a seventh aspect of this invention, there is provided a head driving device of an ink-jet printer which has the construction of one of the first to sixth aspects and which controls the state of each of the semiconductor switching elements according to the pulse width of the pulse signal.

According to an eighth aspect of this invention, there is provided a head driving device of an ink-jet printer which has the construction of one of the first to seventh aspects and in which the transition time between the states of the semiconductor switching elements is controlled according to the pulse interval of the pulse signal.

According to a ninth aspect of this invention, there is provided a head driving device of an ink-jet printer which has the construction of one of the first to eighth aspects and in which the number of transitions between the states of the semiconductor switching elements is controlled according to the number of pulses of the pulse signal.

In the head driving device of the first aspect, the ink-jet head which has a plurality of ink chambers and electrodes for the respective ink chambers arranged side by side and includes electrostrictive elements for causing variations in pressure in the ink chambers by the distorting operation thereof is used as a print head, and the gradation printing can be easily attained and the printing speed can be enhanced by the relatively simple control operation for selectively changing the energization sequence for sequentially distorting the electrostrictive elements of the head.

In the head driving device of the second aspect, the deviation of the printing dots between gradations can be corrected. According to the head driving device of the third aspect, various driving waveforms can be derived from driving waveform information items of a number equal to the number of signal lines by converting driving waveform information into a pulse waveform and inputting the pulse waveform to the driving circuit and then causing the driving circuit to decode the driving waveform information and drive the head, and even when it is desired to change the driving waveform from outside the driving circuit, the driving waveform control can be precisely effected by use of a small number of signal lines.

In the head driving device of the fourth to ninth aspects, even if it is required to change the driving waveforms for the respective ink chambers, it is not necessary to provide a control signal generation circuit for each ink chamber and a circuit can be simplified by independently selecting driving waveform information for each ink chamber from different types of driving waveform information items commonly supplied and effecting the driving control. The driving device can effect the precise driving control since a desired waveform can be freely selected for each ink chamber. Further, it can adjust the driving waveform from the exterior even if the driving circuit is formed in an IC form to make it impossible to change the circuit and can cope with a case wherein it becomes necessary to adjust the driving waveform according to a change in the ink ejection characteristic caused by the change of ink or the like.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

There will now be described a head driving device of an ink-jet printer according to a first embodiment of this invention with reference to the accompanying drawings.

Figure 1:
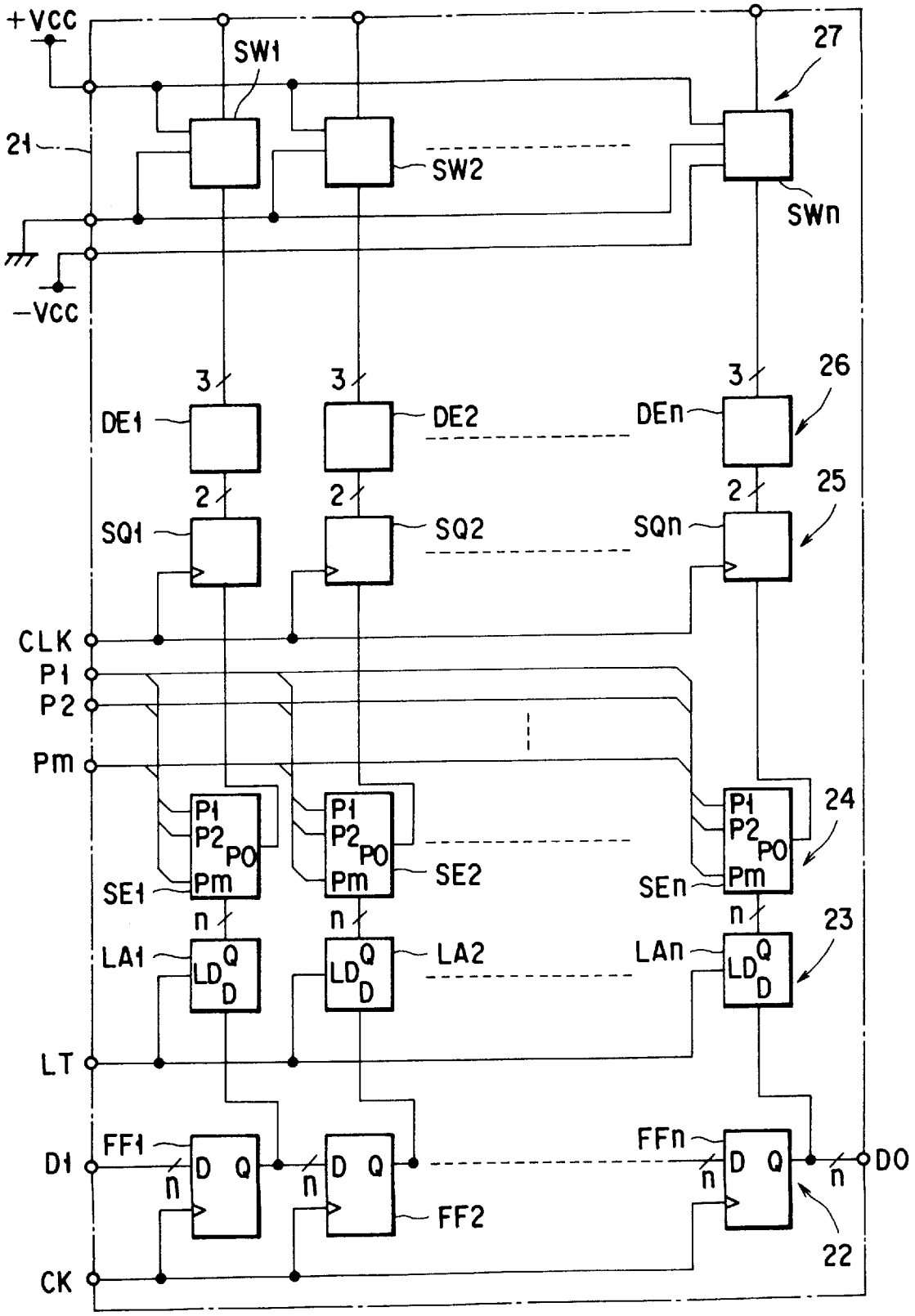
FIG. 1 is a diagram showing the circuit construction of a head driving device of an ink-jet printer according to a first embodiment of this invention.

FIG. 1 shows the circuit construction of the head driving device of the ink-jet printer. The head driving device is formed as a driver IC 21. The driver IC 21 includes a shift register 22 constructed by series-connecting n D-type flip-flops FF1, FF2, - - - , FFn and used as a shift memory, a latch circuit group 23 constructed by n latch circuits LA1, LA2, - - - , LAn, a selector group 24 constructed by n selectors SE1, SE2, - - - , SEn, a sequencer group 25 constructed by n sequencers SQ1, SQ2, - - - , SQn, a decoder group 26 constructed by n decoders DE1, DE2, - - - , DEn and a switching circuit group 27 constructed by switching circuits SW1, SW2, - - - , SWn.

The shift register 22 shifts and stores data of n bits for each dot input from the data input terminal DI into the flip-flops FF1 to FFn for each dot in synchronism with a clock CK. The n-bit data is data indicating the gradation of each dot.

An output (n-bit data) of the flip-flop FFn which is the final stage of the shift register 22 is supplied to the data output terminal DO. An output (n-bit data) of each of the flip-flops FF1 to FFn is also supplied to a corresponding one of the latch circuits LA1 to LAn. Each of the latch circuits LA1 to LAn latches the output of a corresponding one of the flip-flops FF1 to FFn in synchronism with a latch signal LT.

An output (n-bit data) of each of the latch circuits LA1 to LAn is supplied to a corresponding one of the selectors SE1 to SEn. Each of the selectors SE1 to SEn receives m types of pulse signals P1, P2, - - - , Pm having different pulse widths and pulse intervals according to the number of the gradations, selects one of the pulse signals based on n-bit data from a corresponding one of the latch circuits LA1 to LAn and outputs the selected pulse signal as a pulse signal Po. The pulse signals Po from the selectors SE1 to SEn are respectively supplied to the sequencers SQ1 to SQn.

Each of the sequencers SQ1 to SQn generates a sequence signal for determining an energization sequence corresponding to each gradation based on the input pulse signal Po and generates sequence signals S0, S1 of two bits. The sequence signals S0, S1 from each of the sequencers SQ1 to SQn are supplied to a corresponding one of the decoders DE1 to DEn. Each of the decoders DE1 to DEn creates driving signals F1, F2, F3 of three bits based on the sequence signals S0, S1 and supplies the driving signals to a corresponding one of the switching circuits SW1 to SWn of the switching circuit group 27.

Each of the switching circuits SW1 to SWn of the switching circuit group 27 is connected to the +Vcc power source line, −Vcc power source line and ground line.

In practice, the ink-jet head is constructed as a line head for simultaneously printing dots of one line by cascade-connecting a large number of driver ICs 21. In this case, the data output terminal DO of a preceding stage of the driver ICs 21 is connected to the data input terminal DI of a next stage thereof.

Figure 2:
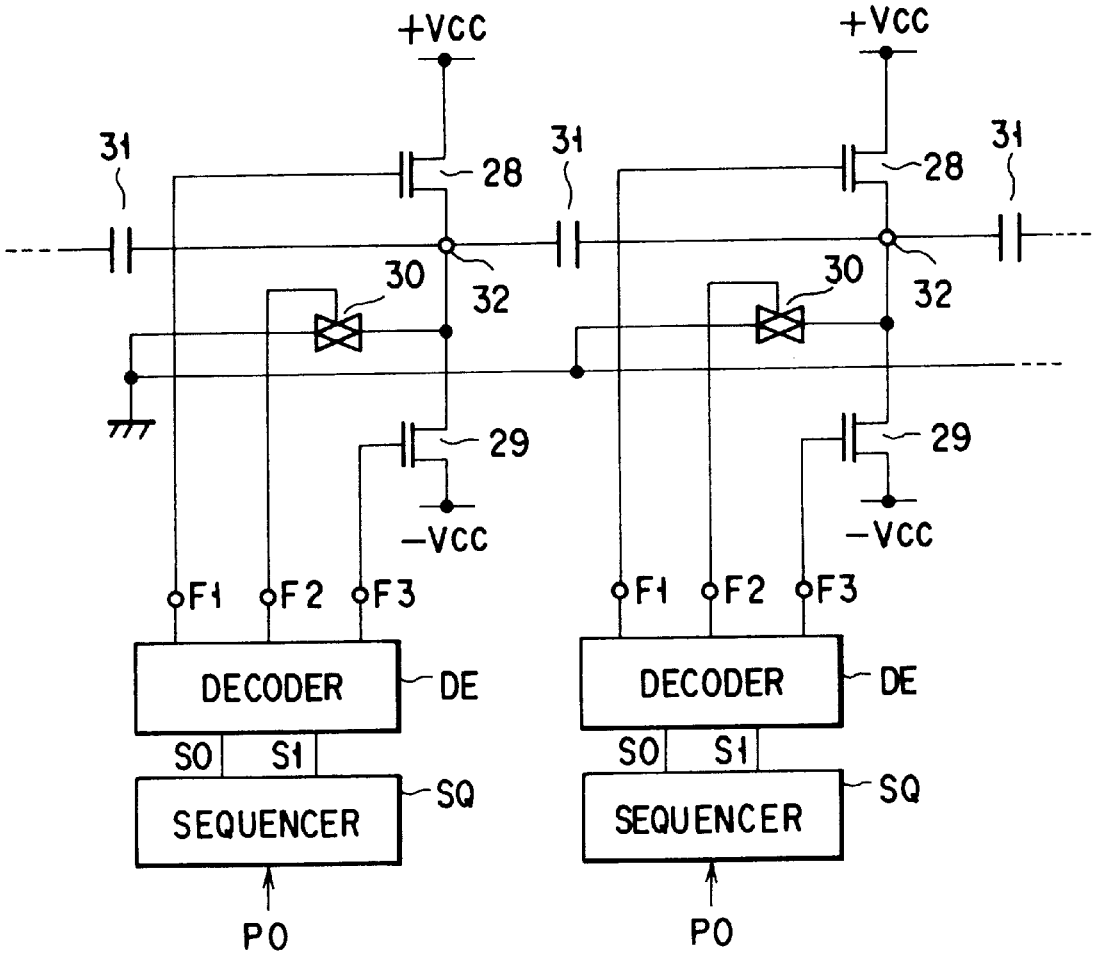
FIG. 2 is a diagram showing a specific construction of a switching circuit in the head driving device shown in FIG. 1.

As shown in FIG. 2, each of the switching circuits SW1 to SWn includes a MOSFET (field effect transistor) 28 constructing a first semiconductor switching element, a MOSFET (field effect transistor) 29 constructing a second semiconductor switching element and a bi-directional switch 30 constructing a third semiconductor switching element, the drain terminal of the MOSFET 28 is connected to the +VCC power source line, the source terminal of the MOSFET 29 is connected to the −VCC power source line, and one end of the bi-directional switch 30 is connected to the ground line. The source terminal of MOSFET 28, the drain terminal of the MOSFET 29 and the other end of the bi-directional switch 30 are connected to an electrode 32 provided on a piezoelectric element 31 which is an electrostrictive element constructing the partition wall of the ink chamber.

The decoder DE (DE1 to DEn) outputs driving signals F1, F2, F3 of three bits in response to sequence signals S0, S1 from the sequencer SQ (SQ1 to SQn) and the driving signals F1, F2, F3 are respectively supplied to the gate terminal of the MOSFET 28, the control terminal of the bi-directional switch 30 and the gate terminal of the MOSFET 29.

Figure 3:
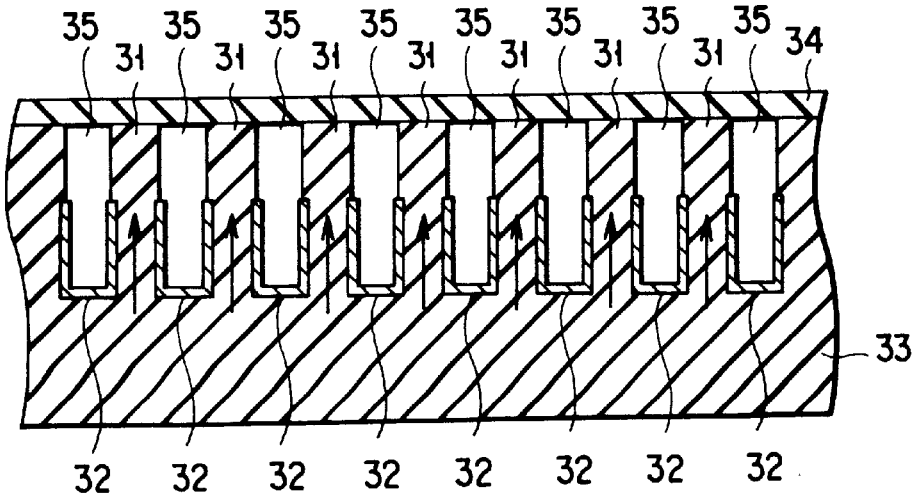
FIG. 3 is a partial cross section showing the structure of an ink-jet head driven by the head driving device shown in FIG. 1.

FIG. 3 shows the construction of the ink-jet head and, for example, a plurality of concave grooves are formed in a piezoelectric member 33 at regular intervals and a roof 34 is fixed to cover the grooves so as to define ink chambers 35 by the grooves. Electrodes 32 are arranged on the side walls and bottom surfaces of the respective ink chambers 35. Nozzles (not shown) for ejecting ink are disposed on the front side of the respective ink chambers 35 and ink supply ports (not shown) are disposed on the rear side thereof. In the above ink-jet head, the piezoelectric elements 31 formed of the piezoelectric member 33 are disposed between the electrodes 32 and the partition wall for separating the ink chambers 35 from each other is constructed by the piezoelectric element 31 disposed between the electrodes 32. The number of ink chambers 35 of the ink-jet head corresponds to the number of dots of one line.

Figure 4:
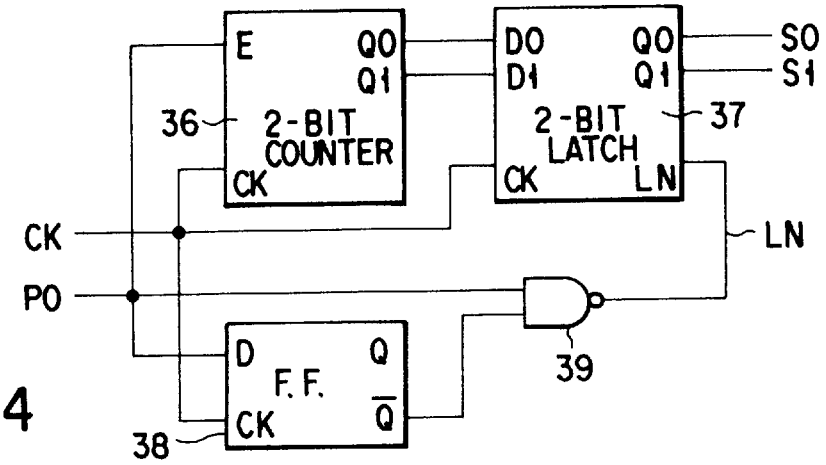
FIG. 4 is a diagram showing the construction of a sequencer in the head driving device shown in FIG. 1.

As shown in FIG. 4, the sequencer SQ includes a 2-bit counter 36, 2-bit latch circuit 37, flip-flop 38 and 2-input NAND gate 39 and the pulse signal Po from a corresponding one of the selectors SE1 to SEn is supplied to the 2-bit counter 36, flip-flop 38 and 2-input NAND gate 39. The 2-bit counter 36 effects the count-up operation in synchronism with the clock CK if the pulse signal Po is set at the low level at the time of input of the clock CK and repeatedly counts values of "0" to "3" so that the count value will vary in the order of "0", "1", "2", "3", "0", "1", - - - .

The flip-flop 38 sets the level state of the pulse signal Po in synchronism with the clock CK and supplies an inverted output of the set state to the NAND gate 39. The NAND gate 39 supplies a NAND output of the inverted output of the flip-flop 38 and the pulse signal Po to the 2-bit latch circuit 37. The 2-bit latch circuit 37 latches the count value of the 2-bit counter 36 in synchronism with the clock CK when the output of the NAND gate 39 is set at the low level. That is, the flip-flop 38 and the NAND gate 39 constitute a rise edge detection circuit. The NAND gate 39 satisfies the logical condition thereof for a period of one clock after the pulse signal Po is changed from the low level to the high level, supplies the low level to the 2-bit latch circuit 37 during this period, and then causes the 2-bit latch circuit 37 to effect the latching operation in synchronism with the clock CK.

Therefore, the values of the sequence signals S0, S1 are updated one clock after the final counting operation of the 2-bit counter 36.

In this case, the 2-bit latch circuit 37, flip-flop 38 and NAND gate 39 constitute a circuit for preventing the sequence signals S0, S1 from being changed during the counting operation of the 2-bit counter 36, and therefore, if the rate of the clock CK is sufficiently high and the influence given to the output waveform while the sequence signals S0, S1 are changed during the counting operation of the 2-bit counter 36 is small, it is possible to omit the above circuits and use the outputs Q0, Q1 of the 2-bit counter 36 as the sequence signals S0, S1 as they are.

Figure 5:
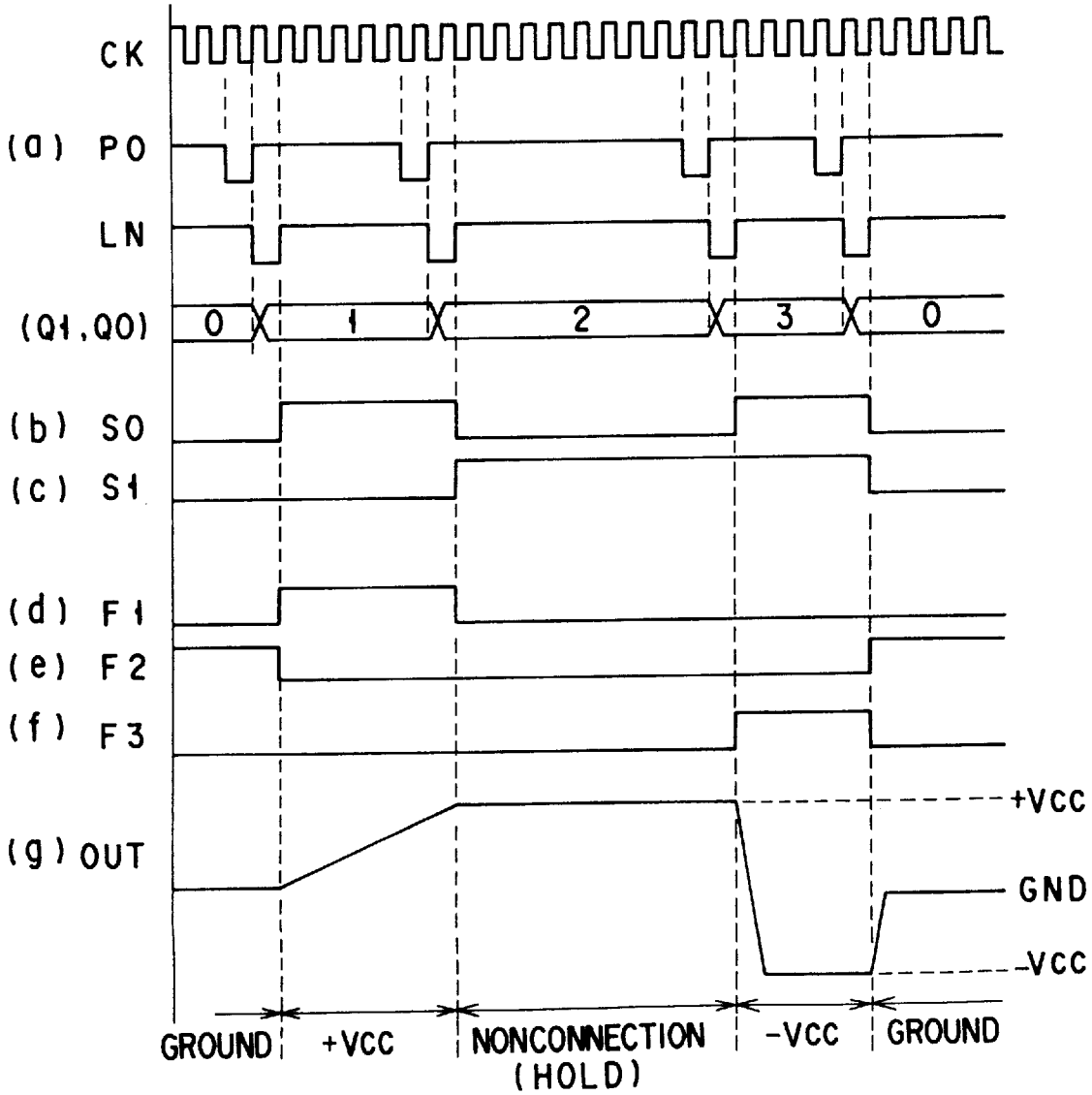
FIG. 5 is a timing chart for illustrating the operations of the sequencer, decoder and switching circuit shown in FIG. 1.

If the pulse signal Po from one of the selectors SE1 to SEn changes as shown in (a) of FIG. 5, the sequence signals S0, S1 from a corresponding one of the sequencers SQ1 to SQn change as shown in (b) and (c) of FIG. 5. Then, a corresponding one of the decoders DE1 to DEn outputs driving signals F1, F2, F3 as shown in (d), (e) and (f) of FIG. 5 in response to the change of the sequence signals S0, S1.

In response to the driving signals F1, F2, F3, the switching circuits SW1 to SWn operate as follows. First, the sequence signals S0, S1 are both set at the low level, the driving signal F1 is set at the low level, the driving signal F2 is set at the high level, and the driving signal F3 is set at the low level before the pulse signal Po is input. In this state, the bi-directional switch 30 is turned ON and one end of the piezoelectric element 31 is connected to the ground line via the electrode 32. At this time, the bi-directional switch 30 of the adjacent switching circuit is turned ON and the other end of the above piezoelectric element 31 is also connected to the ground line.

In this state, if a low level pulse corresponding to one clock of the clock CK is input in synchronism with the clock CK as the pulse signal Po, the sequence signal S0 is set to the high level, the driving signal F1 is set to the high level and the driving signal F2 is set to the low level so that the MOSFET 28 will be turned ON and the bi-directional switch 30 will be turned OFF. As a result, one end of the piezoelectric element 31 is connected to the +Vcc power source line via the electrode 32. In this case, if the ON-resistance of the MOSFET 28 is set high or set to effect the constant-current operation, an output voltage gradually rises towards +Vcc. Then, if a low level pulse corresponding to one clock of the clock CK is input in synchronism with the clock CK as the pulse signal Po after a preset period time has passed, the sequence signal S0 is set to the low level, the sequence signal S1 is set to the high level and the driving signal F1 is set to the low level so that the MOSFET 28 will be turned OFF. As a result, the piezoelectric element 31 is set in the hold state.

In this state, if a low level pulse corresponding to one clock of the clock CK is input in synchronism with the clock CK as the pulse signal Po after a preset period time has passed, the sequence signal S0 is set to the high level again and the driving signal F3 is set to the high level so that the MOSFET 29 will be turned ON and one end of the piezoelectric element 31 is connected to the −Vcc power source line via the electrode 32. Further, if a low level pulse corresponding to one clock of the clock CK is input in synchronism with the clock CK as the pulse signal Po after a preset period time has passed, the sequence signals S0, S1 are both set to the low level, the driving signal F2 is set to the high level and the driving signal F3 is set to the low level so that the MOSFET 29 will be turned OFF and the bi-directional switch 30 will be turned ON to connect one end of the piezoelectric element 31 to the ground line via the electrode 32.

Therefore, a voltage OUT applied to one end of the piezoelectric element 31 in the above sequence of operations varies as shown in (g) of FIG. 5. Since the adjacent bi-directional switch 30 is kept in the ON state in the above sequence of operations, the other end of the piezoelectric element 31 is always connected to the ground line via the adjacent electrode 32. As a result, the voltage across the piezoelectric element 31 sequentially varies with time. That is, the voltage state of the piezoelectric element 31 varies in the order of ground (GND)→+VCC→hold state (nonconnection)→VCC→ground. As a result, the piezoelectric element 31 will effect a desired distorting operation.

The changes of the sequence signals S0, S1, driving signals F1, F2, F3 and application voltage OUT in the above sequence of operations are shown in the following table 1 by use of the truth table.

TABLE 1

| S1 | S0 | F1 | F2 | F3 | OUT |
|---|---|---|---|---|---|
| 0 | 0 | 0 | 1 | 0 | GROUND |
| 0 | 1 | 1 | 0 | 0 | +VCC |
| 1 | 0 | 0 | 0 | 0 | NONCONNECTION |
| 1 | 1 | 0 | 0 | 1 | −VCC |

Figure 6:
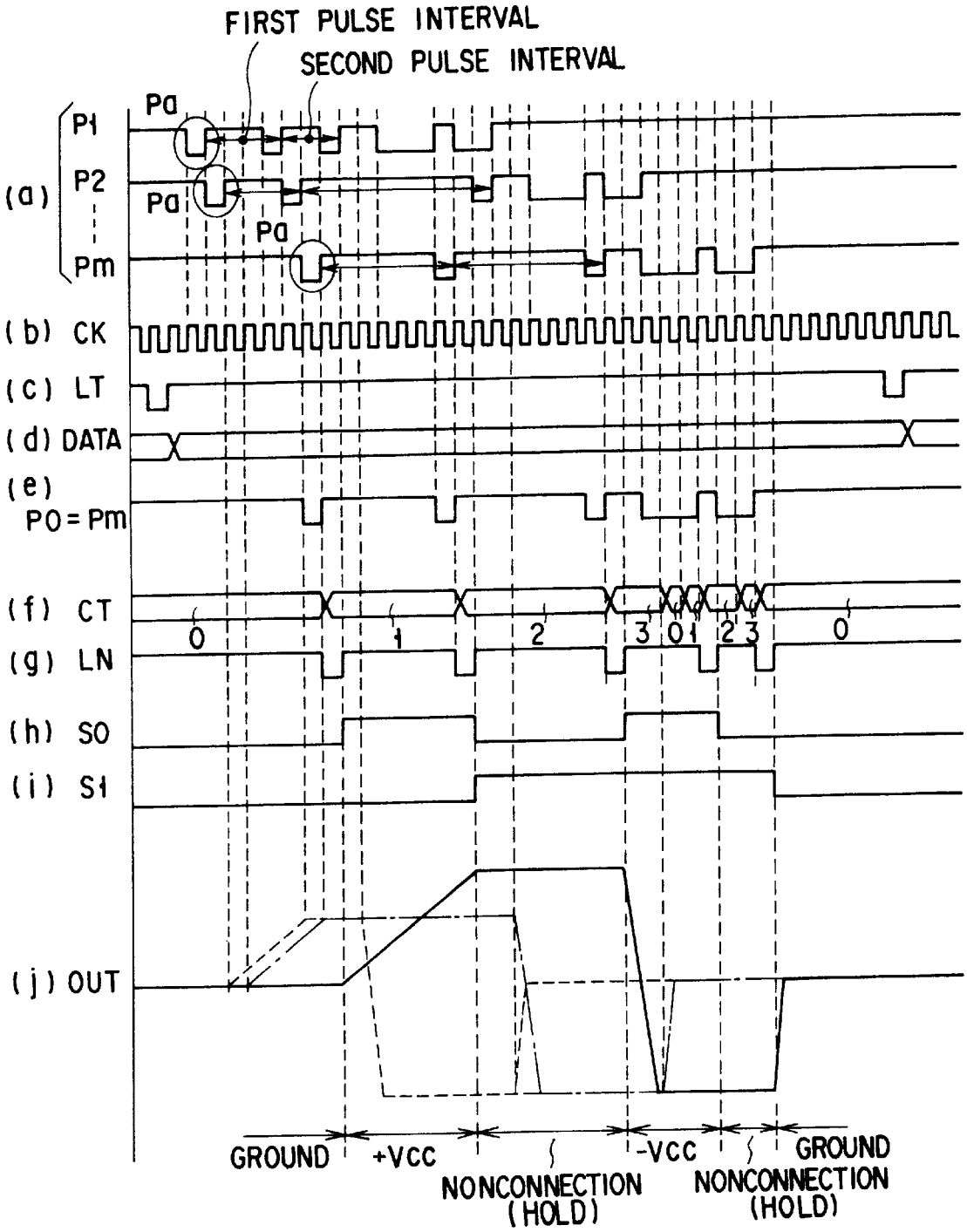
FIG. 6 is a timing chart for illustrating the operation of the whole portion of the head driving device shown in FIG. 1.

If the above operation is regarded as the whole operation of the driver IC 21 and when multivalue gradation data in which each dot is constructed by n bits is input to the data input terminal DI in a state in which the pulse signals P1 to Pm shown in (a) of FIG. 6 are input to the selectors SE (SE1 to SEn), the shift register 22 sequentially shifts and stores the data in synchronism with the clock CK shown in (b) of FIG. 6. When data of one line is stored into the shift register 22, the latch circuits LA (LA1 to LAn) latch data stored in the respective flip-flops FF (FF1 to FFn) of the shift register 22 at a timing at which the latch signal LT is set to the low level as shown in (c) of FIG. 6. Thus, n-bit multivalue gradation data is supplied from the latch circuits LA to the selectors SE at a timing shown in (d) of FIG. 6.

In this case, if the selector SE selects the pulse signal Pm based on the multivalue gradation data, the output pulse signal Po from the selector SE is set to the pulse signal Pm as shown in (e) of FIG. 6. The pulse signal Po is supplied to the sequencer SQ (SQ1 to SQn).

In the sequencer SQ, the count value CT of the 2-bit counter 36 is initially set at "0" but is set to "1" by first inversion of the pulse signal Po to the low level. Then, the pulse signal Po is immediately returned to the high level so as to cause the 2-bit latch circuit 37 to latch the count value "1" of the counter 36. When the pulse signal Po is inverted to and kept at the low level again for a short time after a preset period time and then returned to the high level, the count value of the counter 36 is set to "2" and the latch circuit 36 latches the value. Further, when a preset period time has passed and the pulse signal Po is inverted to and kept at the low level again for a short time and then returned to the high level, the count value of the counter 36 is set to "3" and the latch circuit 36 latches the value.

Further, if the pulse signal Po is inverted to the low level after a preset period of time and this state is maintained for time corresponding to three clocks, the following operation is effected. The count value of the counter 36 is set to "0" in response to the first clock CK, and the count value is set to "1" since the pulse signal Po is still kept at the low level when a next clock CK is input. At this time, the latch circuit 37 continuously holds the count value "3". Further, the count value is set to "2" since the pulse signal Po is still kept at the low level when a next clock CK is input. Also, at this time, the latch circuit 37 continuously holds the count value "3".

When the pulse signal Po is returned to the high level at the time of input of a next clock CK, the latch circuit 37 latches the count value "2". In this state, if the pulse signal Po is inverted to the low level again and this state is maintained for time corresponding to two clocks, the following operation is effected. The count value of the counter 36 is set to "3" in response to the first clock CK, and the count value is set to "0" since the pulse signal Po is still kept at the low level when a next clock CK is input. At this time, the latch circuit 37 continuously holds the count value "2". When the pulse signal Po is returned to the high level at the time of input of a next clock CK, the latch circuit 37 latches the count value "0".

Thus, the count value CT of the 2-bit counter 36 changes as shown in (f) of FIG. 6 according to the pulse signal Po shown in (e) of FIG. 6 and an output LN of the NAND gate 39 of the sequencer SQ changes as shown in (g) of FIG. 6. Further, the sequence signals S0, S1 output from the 2-bit latch circuit 37 change as shown in (h) and (i) of FIG. 6, and as a result, the voltage OUT applied to one end of the piezoelectric element 31 sequentially changes with time as shown in (j) of FIG. 6 according to the truth table indicated by the table 1. Thus, the piezoelectric element 31 effects the desired distorting operation.

Figure 7:
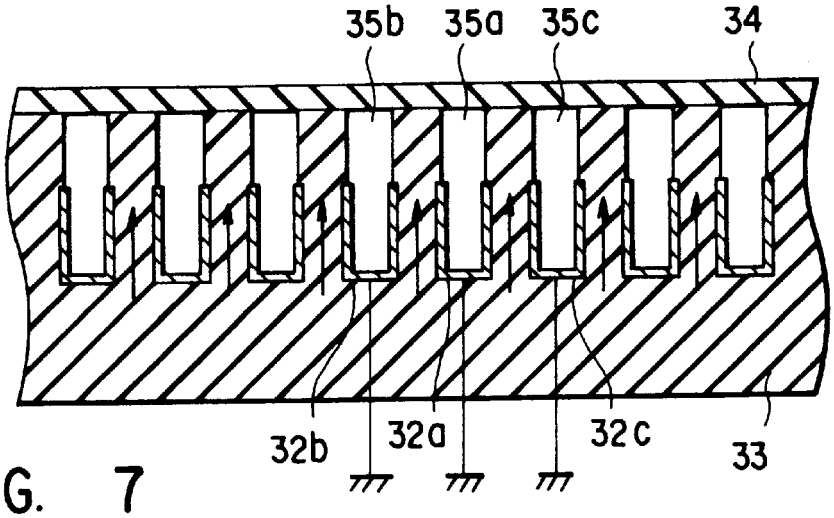
FIGS. 7 to 9 are views for illustrating the operation of piezoelectric elements provided in the ink-jet head shown in FIG. 3.

For example, when attention is given to an ink chamber 35*a* and ink chambers 35*b* and 35*c* which are disposed adjacent to the ink chamber 35*a* as shown in FIG. 7, the driving signal F2 is set in the high level state at the normal time and the bi-directional switch 30 is set in the ON state. Therefore, electrodes 32*a*, 32*b* and 32*c* of the ink chambers 35*a*, 35*b*, 35*c* are connected to the ground line. In the drawing, arrows indicate the polarization direction of the piezoelectric element 31.

Figure 8:
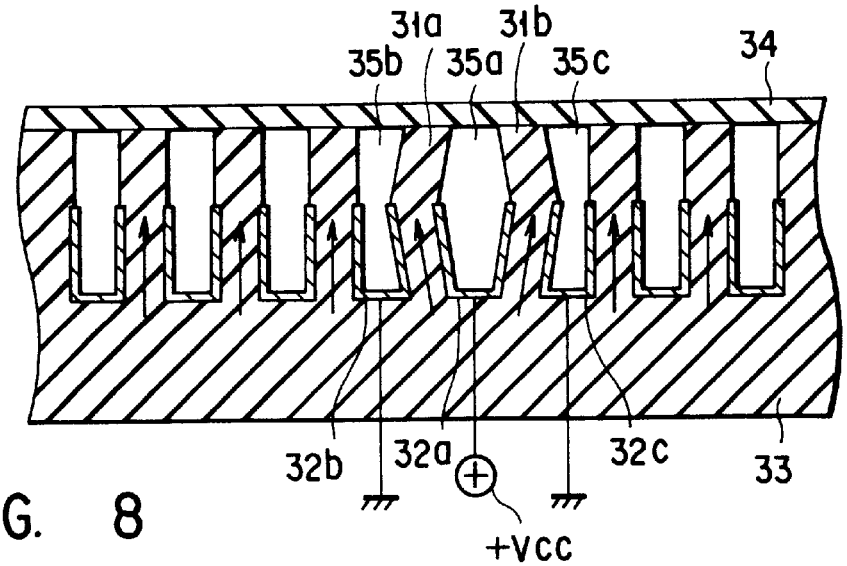
Figure 9:
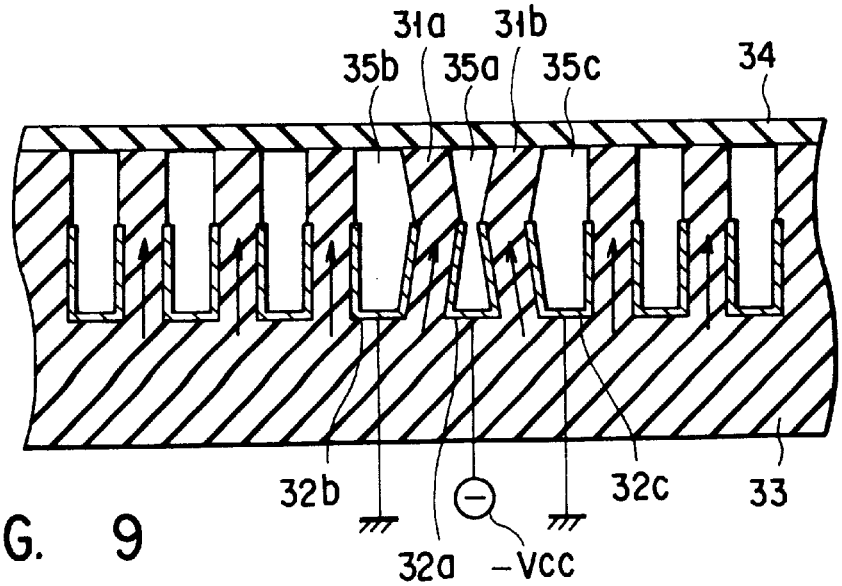

In this state, if the driving signal F1 from a decoder corresponding to the ink chamber 35*a* is set to the high level and the driving signal F2 is set to the low level, the FET 28 is turned ON and the bi-directional switch 30 is turned OFF. As a result, the electrode 32*a* of the ink chamber 35*a* is connected to the +Vcc line as shown in FIG. 8. Then, the piezoelectric element 31 a between the ink chamber 35*a* and the ink chamber 35*b* and the piezoelectric element 31*b* between the ink chamber 35*a* and the ink chamber 35*c* are distorted to respectively bend towards the ink chambers 35*b* and 35*c*. Thus, the volume of the ink chamber 35*a* is increased. After this, this state is maintained even when the driving signal F1 is set to the low level and the FET 28 is turned OFF. Then, when the driving signal F3 is set to the high level, the FET 29 is turned ON. As a result, the electrode 32*a* of the ink chamber 35*a* is connected to the −Vcc power source line as shown in FIG. 9. Then, the piezoelectric element 31*a* between the ink chamber 35*a* and the ink chamber 35*b* and the piezoelectric element 31*b* between the ink chamber 35*a* and the ink chamber 35*c* are distorted to bend in the reverse direction towards the ink chamber 35*a* this time. Thus, the volume of the ink chamber 35*a* is reduced. The reduction in volume increases the pressure in the ink chamber 35*a* so as to cause ink in the ink chamber 35*a* to be eject from the nozzle. That is, the dot printing takes place.

If the selector SE selects the pulse signal P1 based on multivalue gradation data from the latch circuit LA and when the sequencer SQ generates sequence signals S0, S1 in response to the pulse signal P1 to drive the switching circuit SW, a voltage OUT applied to one end of the piezoelectric element 31 changes as indicated by a waveform of broken lines in (j) of FIG. 6 since the first pulse interval and the second pulse interval of the pulse signal P1 are different from and shorter than those of the pulse signal Pm. That is, the application voltage and time are changed when the sequential control is effected for the piezoelectric element 31.

Therefore, the distorting operation of the piezoelectric element 31 subjected to the above sequential control is different from that effected in a case wherein the pulse signal Pm is used. As a result, the amount of ink ejected from the nozzle of the ink chamber is changed. Further, in a case where the selector SE selects the pulse signal P2 based on multivalue gradation data from the latch circuit LA, the pulse signal P2 is different from the pulse signal Pm in the first pulse interval and the second pulse interval and is different from the pulse signal P1 in the second pulse interval. When the sequencer SQ generates sequence signals S0, S1 in response to the pulse signal P2 to drive the switching circuit SW, a voltage OUT applied to one end of the piezoelectric element 31 changes as indicated by a waveform of one-dot-dash lines in (j) of FIG. 6.

Therefore, the distorting operation of the piezoelectric element 31 subjected to the above sequential control is different from both of a case wherein the pulse signal Pm is used and a case wherein the pulse signal P1 is used. As a result, the amount of ink ejected from the nozzle of the ink chamber is further changed.

Thus, the amount of ink ejected from the nozzle of the ink chamber can be changed by changing the pulse signal which is selected by the selector SE based on multivalue gradation data. Therefore, if pulse signals P1 to Pm of a number corresponding to the number of gradations for controlling the application voltage to the piezoelectric element, application time and sequence to eject an amount of ink corresponding to multivalue gradation data are prepared and supplied to the driving circuits corresponding to all of the ink chambers of the ink-jet head, each of the driving circuits for the ink chambers can perform the gradation printing for each dot by selecting one of the pulse signals.

In the above ink-jet head, since ink in the ink chamber is ejected by utilizing the distorting operation of the piezoelectric element 31 constructing the partition wall between the adjacent ink chambers, ejection of ink of the successive ink chambers cannot be continuously effected. Therefore, a so-called two-cycle driving method in which the process for operating the alternate ink chambers is effected twice for one-line printing or a so-called three-cycle driving method in which the process for operating the every third ink chamber is effected three times for one-line printing is effected, for example.

However, even if the two-cycle driving method and three-cycle driving method are effected, the distorting operation of the piezoelectric element 31 can be effected by use of time which is equal to half or one-third the time required for one-line printing, the time for operating the piezoelectric elements can be made sufficiently long in comparison with a case of the serial ink-jet head using piezoelectric elements, and the operation time for sequentially driving the piezoelectric elements 31 can be set to have sufficient degrees of freedom.

Therefore, the application voltage to the piezoelectric element 31, the voltage application time and the like can be easily changed and excellent gradation printing can be attained. In addition, since one-line printing can be performed simply by repeating the distorting operation of the piezoelectric element two or three times, the printing speed can be enhanced in comparison with a case wherein the serial ink-jet head is used.

Further, unlike the serial ink-jet head, it is not necessary to effect the complicated control process for simultaneously preparing voltage levels and timings which are different for respective dots in one column and control them for respective dots of one line while changing them at the column frequency, and it is only required to effect the two-cycle driving process or three-cycle driving process for one-line printing and the gradation printing can be performed by relatively simple control.

In the case of a system for ejecting ink by applying pressure to the ink chamber 35 according to the distorting operation of the piezoelectric element, if the gradation printing is performed while changing an application voltage to the piezoelectric element 31 and the voltage application time, a deviation in the dot printing position may occur because of a difference between the gradations of the dots. Therefore, the deviation in the dot printing position is corrected by changing the position of the pulse signals P1 to Pm. For example, the deviation in the dot printing position caused by a difference in the gradation is corrected by shifting the rise timings of the first pulses Pa of the pulse signals P1 to Pm from one another as shown in (a) of FIG. 6 so as to adjust the timing of ejection of ink from the nozzle of the ink chamber 35.

By performing the above correction, the dot printing position can always be precisely controlled and excellent printing can be attained even if the gradations are different.

Further, in the case of a dot which is not printed, the operation of controlling such a non-printing dot can be easily attained by preparing a pulse which prevents the sequence signals S0, S1 output from the sequencer SQ from operating the piezoelectric element 31, that is, which causes the sequence signals S0, S1 to be both set at the low level in the pulse signals P1 to Pm as a pulse signal and causing the selector SE to select the above pulse signal when n-bit data from the latch circuit LA is non-printing data.

Since the pulse signals P1 to Pm are supplied from outside the driver IC 21, the driving waveform can be adjusted from the exterior even if the driving circuit is thus formed in an IC form and the circuit construction cannot be changed, and therefore, it is only required to change the pulse signal supplied from the exterior when it becomes necessary to adjust the driving waveform according to a change in the ink ejection characteristic caused by the change of ink or the like.

Next, a head driving device of an ink-jet printer according to a second embodiment of this invention is explained with reference to FIG. 10.

In the operation of the switching circuits SW1 to SWn of the head driving device in the first embodiment, the sequence of the state transitions thereof and the time lengths between the states are determined according to the pulse widths and time lengths of the pulse signals P1 to Pm supplied to the sequencer SQ. Therefore, the output waveform can be relatively freely controlled according to the pulse widths, time lengths and the number of pulses of the pulse signals P1 to Pm and the driving operation can be effected by using a combination of waveforms which are completely different for respective gradations.

Figure 10:
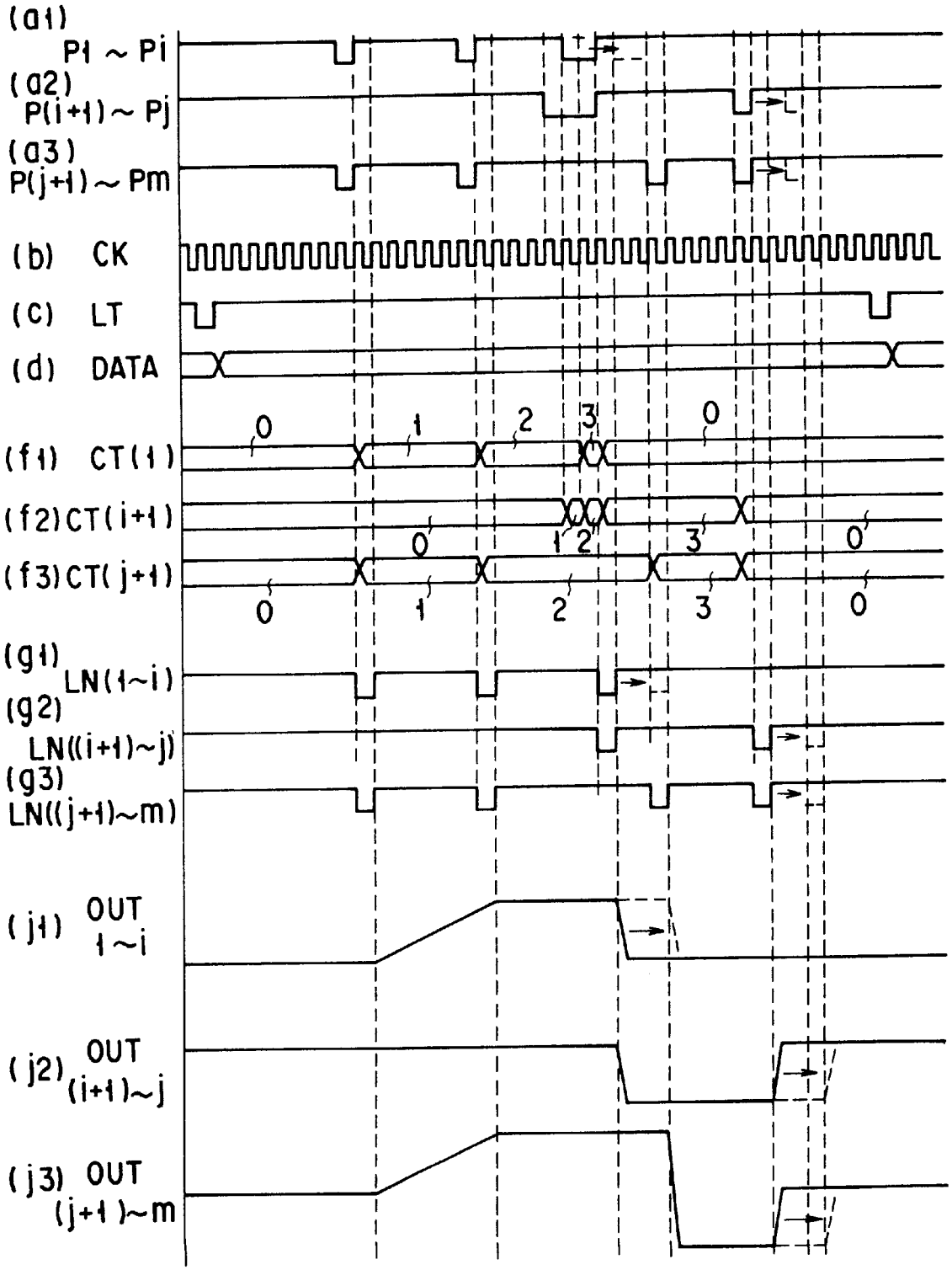
FIG. 10 is a timing chart for illustrating the operation of the whole portion of a head driving device of an ink-jet printer according to a second embodiment of this invention.
Figure 11:
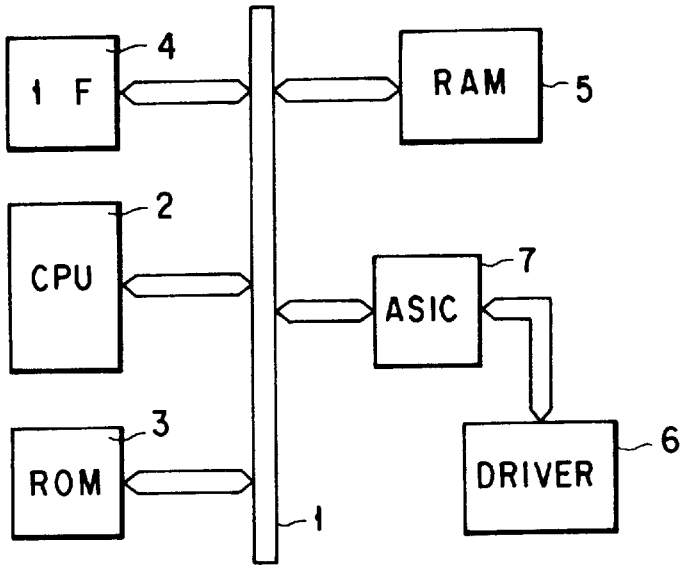
FIG. 11 (PRIOR ART)
FIG. 11 is a block diagram showing the circuit construction of a conventional line thermal printer.
Figure 13:
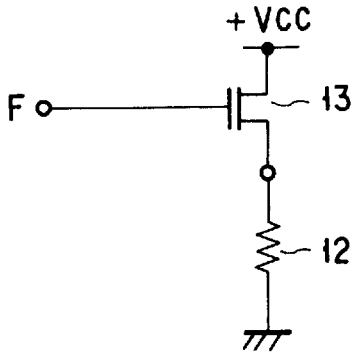
FIG. 13 (PRIOR ART)
FIG. 13 is a circuit diagram of a switching circuit shown in FIG. 11.
Figure 12:
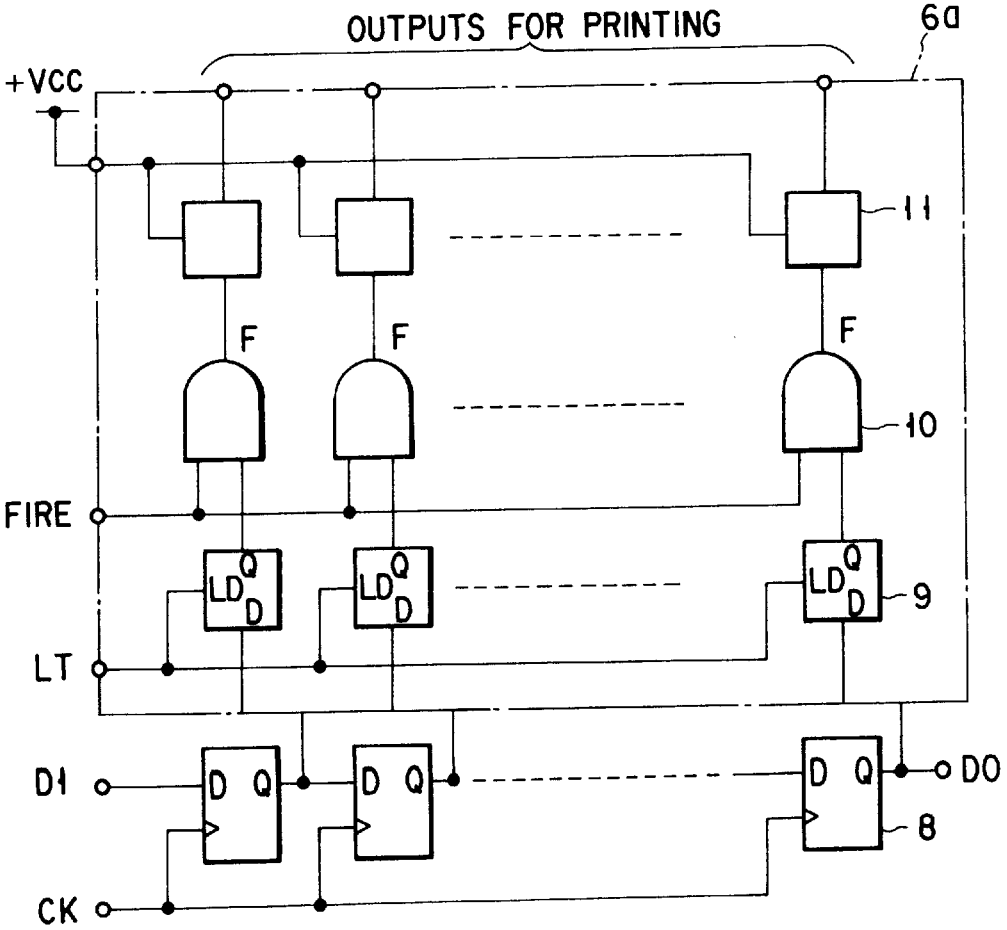
FIG. 12 (PRIOR ART)
FIG. 12 is a circuit diagram of a driver shown in FIG. 11.
Figure 14:
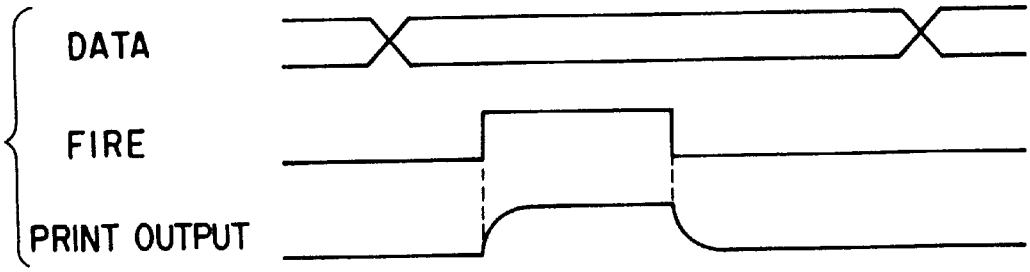
FIG. 14 (PRIOR ART)
FIG. 14 is a timing chart of latch data, energization signal and print outputs obtained in the line thermal printer shown in FIG. 11.
Figure 15:
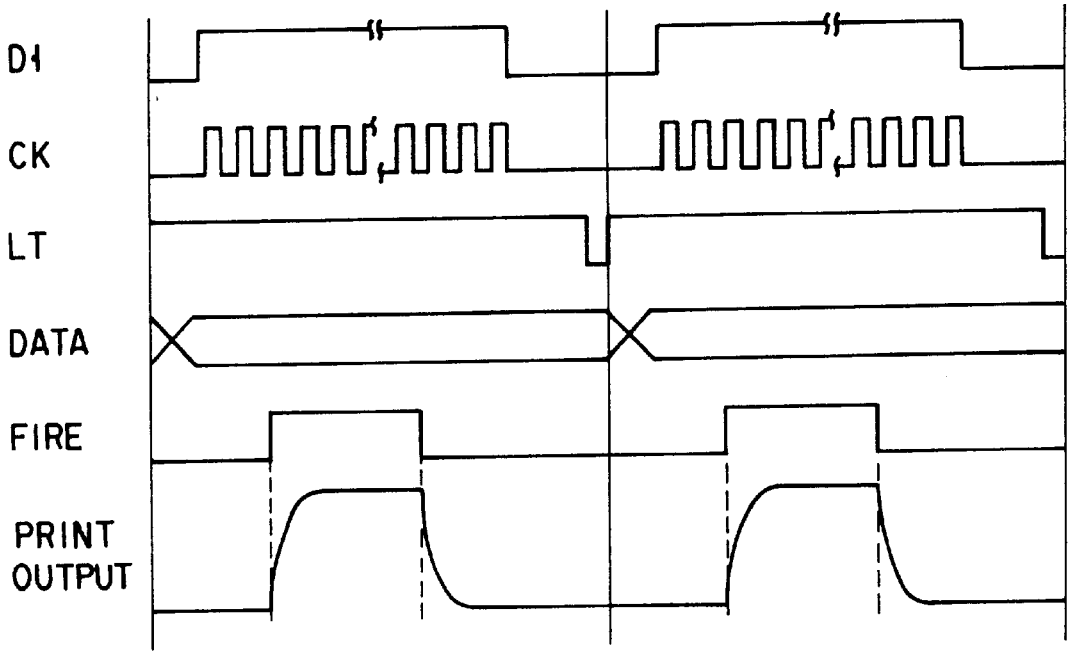
FIG. 15 (PRIOR ART)
FIG. 15 is a timing chart for illustrating the operation of the whole portion of the driver shown in FIG. 12.

The whole portion of the head driving device of the ink-jet printer according to the second embodiment is operated as shown in FIG. 10. In the operation, the gradations of m levels are divided into three ranges of {1 to i}, {(i+1) to j} and {(j+1) to m} and driving systems different for the respective ranges are used. The circuit construction of the head driving device is exactly the same as that in the first embodiment and the driving systems can be attained simply by changing the pulse signals to be supplied. In this case, the gradation values are set in the order of $1<i<j<m$ and ink drops of small size to large size can be eject.

Since it is necessary to eject a relatively small ink drop when the gradation value lies in the range of 1 to i, the ink ejection is effected by changing the state of the ink chamber in the order of FIG. 7→FIG. 8→FIG. 7. Since, in this driving system, the state of FIG. 8 in which the meniscus is retarded is returned to the state of FIG. 7 to eject ink, a small ink drop can be easily ejected. The driving waveform for causing the operation may be made as shown in (j1) of FIG. 10 and a pulse signal for generating the above waveform may be set as shown in (a1) of FIG. 10. At this time, the value of the counter 36 of the sequencer SQ changes at the timing and in the sequence shown in (f1) of FIG. 10. In order to further change the size of the ink drop in the operation range, it is only necessary to change the time of the state of FIG. 8 so as to adjust the time for waiting until the retarded meniscus returns to its original position. At this time, the driving waveform may be changed as indicated by broken lines in (j1) of FIG. 10, and for this purpose, the pulse signal may be changed as indicated by broken lines in (a1) of FIG. 10.

Since it is necessary to eject a medium size ink drop when the gradation value lies in the range of (i+1) to j, the ink ejection is effected by changing the state of the ink chamber in the order of FIG. 7→FIG. 9→FIG. 7. In this driving system, the medium size ink drop is ejected by extruding ink in the state of FIG. 9. The driving waveform for causing the operation may be made as shown in (j2) of FIG. 10 and a pulse signal for generating the waveform may be set as shown in (a2) of FIG. 10. At this time, the value of the counter 36 of the sequencer SQ changes at the timing and in the sequence shown in (f2) of FIG. 10. In order to further change the size of the ink drop in the operation range, it is only necessary to change the time of the state of FIG. 9, that is, ink extruding time. At this time, the driving waveform may be changed as indicated by broken lines in (j2) of FIG. 10, and for this purpose, the pulse signal may be changed as indicated by broken lines in (a2) of FIG. 10.

Since it is necessary to eject a large ink drop when the gradation value lies in the range of (j+1) to m, the ink ejection is effected by changing the state of the ink chamber in the order of FIG. 7→FIG. 8→FIG. 9→FIG. 7. In this driving system, since ink is extruded in the state of FIG. 9 after the ink chamber has been expanded in FIG. 8, the amplitude of vibration of the partition wall is large and thus a large ink drop can be ejected. The driving waveform for causing the operation may be made as shown in (j3) of FIG. 10 and a pulse signal for generating the waveform may be set as shown in (a3) of FIG. 10. At this time, the value of the counter 36 of the sequencer SQ changes at the timing and in the sequence shown in (f3) of FIG. 10. In order to further change the size of the ink drop in the operation range, it is only necessary to change the time of the state of FIG. 9, that is, ink extruding time. At this time, the driving waveform may be changed as indicated by broken lines in (j3) of FIG. 10, and for this purpose, the pulse signal may be changed as indicated by broken lines in (a3) of FIG. 10.

In this invention, the driving system which can be used in the head driving device is not limited to the above-described embodiments and various driving waveforms can be independently generated for each pulse signal depending on the pulse width, time length and the number of pulses of the pulse signal. For example, in a case where the necessary conditions such as the ejection volume control and the presence or absence, the number and the waveform of auxiliary pulses inserted for the purpose of damping of pressure vibration of the ink chamber are changed, it is possible to cope with this case by changing a corresponding pulse signal. Further, it is possible to repeatedly generate a set of pulses necessary for ejecting one ink drop to form one dot by use of a plurality of ejection pulses and represent the gradation by the number of ink drops ejected by changing the repetition rate for each pulse signal.

One pulse signal is not necessarily set in one-to-one correspondence to one degree of gradation for representing a gradation image and, for example, it is possible to select a different pulse signal for each dot even for an image of the same gradation in order to serve the purpose of correcting a variation in the characteristic of each dot caused by a variation in head in the manufacturing process.

In each of the above embodiments, the number of switches is set to 3 and the number of levels of the power source potentials is set to 3 in the head driving device, but they are not limited to the above case and it is possible to increase the number of types of driving waveforms which can be generated if the number of types of the power sources and the number of switches are increased to increase the number of bits of the sequencer and thus the driving control can be more precisely effected. Further, the number of types of driving waveforms can be increased by connecting a plurality of switches to the same power source via different resistors and controlling them by the sequencer. If the number of bits of the sequencer is increased, time required for the state transition of the switch is made longer, but in a case where the number of switches is large and the processing speed has precedence over the simplicity of the circuit, it is possible to increase the number of switches which can be controlled without changing the processing time by constructing a pulse signal corresponding to one driving waveform by a plurality of pulses and providing plural sets of selection circuits for each electrode.

This invention is not limited to the above description and can be variously modified without departing from the technical scope thereof.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A printer comprising:

a print head having dot-printing actuators which include operation states for printing a line of dots; and a driving circuit operatively coupled to said print head for driving said print head, the driving circuit applying drive signals to the print head to control the operation states of the dot-printing actuators, said driving circuit receiving dot data for each dot of the line of dots and a set of pulse signals wherein each pulse signal contains driving waveform information encoded into a number of pulse transitions and a time interval between pulse transitions, said driving circuit comprising:

a pulse signal selecting circuit for selecting one of said pulse signals for the dot data; and varying the drive signal to be applied to a related dot-printing actuator of the print head based on the driving waveform information contained in the selected pulse signal.

2. The printer according to claim 1, wherein the set of pulse signals are produced for different gradations to be designated by variations of the dot data.

3. The printer according to claim 1, wherein when a positional deviation is undesirably present between dots printed via said dot-printing actuators, pulse positions of the pulse signals are determined such that a time of starting the varying sequence of the drive signal to be applied to the related dot-printing actuator is shifted to correct the positional deviation.

4. The printer according to claim 1, wherein said driving circuit includes a plurality of power source lines set at different voltage levels, and a plurality of switching circuits each for selectively connecting a corresponding dot-printing actuator to one of said power source lines and disconnecting the corresponding dot-printing actuator from said power source lines, and said determining circuit including a switch control circuit for determining an order and period of connection states in the switching circuit for the related dot-printing actuator based on the driving waveform information contained in the selected pulse signal.

5. The printer according to claim 4, wherein said pulse signal selecting circuit includes a pulse signal input port for receiving said pulse signals, and wherein the pulse signal selecting circuit also includes a plurality of selectors each for selecting one of the pulse signals to control a corresponding switching circuit.

6. The printer according to claim 5, wherein each of said switching circuits includes a plurality of switching elements connected between said power source lines and a corresponding dot-printing actuator and wherein said switch control circuit includes a plurality of sequencers for producing sequence signals whose logic values vary in response to the pulse signals selected by said selectors, and a plurality of decoders for decoding the sequence signals from said sequencers to sequentially and exclusively turn on said switching elements of said switching circuits.

7. The printer according to claim 6, wherein each of said sequencers includes a counter for detecting the pulse width of the selected pulse signal.

8. The printer according to claim 7, wherein each of said sequencers further includes a latching circuit for latching an output signal from said counter.

9. The printer according to claim 4, wherein each of said connection states is determined by a pulse width of the selected pulse signal.

10. The printer according to claim 9, wherein a period of a transition between said connection states is determined by the pulse interval of the selected pulse signal.

11. The printer according to claim 10, wherein a number of transitions between said connection states is determined by the number of pulses in the selected pulse signal.

12. The printer according to claim 9, wherein a number of transitions between said connection states is determined by the number of pulses in the selected pulse signal.

13. The printer according to claim 4, wherein a period of a transition between said connection states is determined by a pulse interval of the selected pulse signal.

14. The printer according to claim 4, wherein a number of transitions between said connection states is determined by the number of pulses in the selected pulse signal.

* * * * *